US010450709B2

(12) United States Patent
Emme et al.

(10) Patent No.: US 10,450,709 B2
(45) **Date of Patent: *Oct. 22, 2019**

(54) SELF-PROPELLED ROAD MILLING MACHINE FOR MILLING ROAD SURFACES, IN PARTICULAR LARGE-SCALE MILLING MACHINE, AND METHOD FOR MILLING ROAD SURFACES

(71) Applicant: Wirtgen GmbH, Windhagen (DE)

(72) Inventors: Hardy Emme, Dattenberg (DE); Cyrus Barimani, Konigswinter (DE); Andreas Salz, Neustadt/Wied (DE)

(73) Assignee: Wirtgen GmbH (DE)

( * ) Notice: Subject to any disclaimer, the term of this patent is extended or adjusted under 35 U.S.C. 154(b) by 196 days.

This patent is subject to a terminal disclaimer.

(21) Appl. No.: 15/232,905

(22) Filed: Aug. 10, 2016

(65) Prior Publication Data

US 2017/0030033 A1 Feb. 2, 2017

Related U.S. Application Data

(63) Continuation of application No. 13/786,940, filed on Mar. 6, 2013, now Pat. No. 9,416,502.

(30) Foreign Application Priority Data

Mar. 8, 2012 (DE) ..... 10 2012 203 649

(51) Int. Cl.
*E01C 23/08* (2006.01)
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS 3,767,262 A * 10/1973 Pentith ..... E01C 23/088 172/122
4,197,032 A * 4/1980 Miller ..... E01C 19/4893 172/108

(Continued)

FOREIGN PATENT DOCUMENTS

CN 101338545 A 1/2009
CN 101736677 A 6/2010

(Continued)

OTHER PUBLICATIONS

European Search Report in corresponding European Patent Application EP 16 20 1742, dated Feb. 20, 2017, 3 pp. (not prior art).

(Continued)

*Primary Examiner* — Janine M Kreck
(74) *Attorney, Agent, or Firm* — Lucian Wayne Beavers; Patterson Intellectual Property Law, PC

(57) ABSTRACT

In a self-propelled road milling machine for milling road surfaces comprising a milling roller housing arranged at the machine frame between the front and rear chassis axles, it is provided that the rear end, as seen in the direction of travel, of the milling roller housing is flush with a height adjustable stripper shield which laterally rests in the milling track of the milling roller and resiliently against a milling edge of the milling track extending orthogonally to the road surface.

13 Claims, 5 Drawing Sheets

(56) References Cited

U.S. PATENT DOCUMENTS

| | | | | | |
|---|---|---|---|---|---|
| 4,714,374 | A * | 12/1987 | Mihara | B28D 1/18 | 299/39.5 |
| 4,808,026 | A * | 2/1989 | Clarke, Jr. | E01C 19/187 | 172/108 |
| 5,203,615 | A | 4/1993 | Zanetis et al. | | |
| 5,321,625 | A | 6/1994 | Humm et al. | | |
| 5,382,084 | A | 1/1995 | Diver et al. | | |
| 5,474,397 | A | 12/1995 | Lyons | | |
| 5,695,256 | A * | 12/1997 | Kishimoto | E01C 23/088 | 299/39.2 |
| 5,722,789 | A * | 3/1998 | Murray | B28D 1/18 | 299/39.4 |
| 6,116,699 | A * | 9/2000 | Kaczmarski | E01C 23/088 | 299/36.1 |
| 6,296,318 | B1 * | 10/2001 | Simons | E01C 23/088 | 198/300 |
| 6,457,779 | B1 | 10/2002 | Busley et al. | | |
| 6,923,508 | B2 | 8/2005 | Holl et al. | | |
| 7,131,704 | B2 | 11/2006 | Murray et al. | | |
| 7,175,364 | B2 | 2/2007 | Gaertner et al. | | |
| 7,370,916 | B2 | 5/2008 | Ley et al. | | |
| 7,438,364 | B2 | 10/2008 | Boehme et al. | | |
| 7,748,789 | B2 | 7/2010 | Freeburn | | |
| 7,753,620 | B2 | 7/2010 | Kötting et al. | | |
| 8,256,847 | B2 * | 9/2012 | Hall | E01C 23/088 | 299/39.4 |
| 9,416,502 | B2 * | 8/2016 | Emme | E01C 23/088 | |
| 2004/0075330 | A1 | 4/2004 | Holl et al. | | |
| 2005/0123350 | A1 | 6/2005 | Ley et al. | | |
| 2005/0179309 | A1 | 8/2005 | Berning et al. | | |
| 2007/0127986 | A1 | 6/2007 | Boehme et al. | | |
| 2008/0267706 | A1 | 10/2008 | Hall et al. | | |
| 2008/0292399 | A1 | 11/2008 | Freeburn | | |
| 2009/0010713 | A1 | 1/2009 | Kotting et al. | | |
| 2010/0327651 | A1 * | 12/2010 | Cipriani | E01C 23/088 | 299/39.2 |
| 2013/0195554 | A1 | 9/2013 | Rukavina et al. | | |
| 2014/0361599 | A1 | 12/2014 | Losen et al. | | |

FOREIGN PATENT DOCUMENTS

| | | | |
|---|---|---|---|
| CN | 202073018 | U | 12/2011 |
| DE | 2420330 | A1 | 11/1975 |
| DE | 2540047 | A1 | 3/1977 |
| DE | 8315139.7 | U1 | 2/1984 |
| DE | 3409389 | A1 | 10/1985 |
| DE | 3508884 | A1 | 9/1986 |
| DE | 3823480 | C1 | 10/1989 |
| DE | 19814053 | A1 | 10/1999 |
| DE | 102005058102 | B3 | 3/2007 |
| EP | 0685598 | A1 | 12/1995 |
| EP | 0752501 | A1 | 1/1997 |
| EP | 1408158 | A1 | 4/2004 |
| EP | 1793041 | A1 | 6/2007 |
| EP | 2011921 | A2 | 1/2009 |
| GB | 2155525 | A | 9/1985 |
| JP | 57160310 | U | 10/1982 |
| JP | 06001411 | A | 1/1994 |
| JP | 0921107 | A | 1/1997 |
| JP | 09324404 | A | 12/1997 |
| JP | 2000517018 | A | 12/2000 |
| JP | 2002510000 | A | 4/2002 |
| JP | 2009013777 | A | 1/2009 |
| JP | 2010138559 | A | 6/2010 |

OTHER PUBLICATIONS

European Search Report in corresponding European Patent Application EP 13 15 7759, dated Jun. 19, 2013, 2 pp. (not prior art).
International Search Report in International Patent Application PCT/EP2013/052895, dated May 10, 2013, 3 pp. (not prior art).
International Written Opinion in International Patent Application PCT/EP2013/052895, dated May 10, 2013, 7 pp. (not prior art).
EPO Office Action dated May 23, 2018 in corresponding application 16201742.0, 8 pages (not prior art).

* cited by examiner

SELF-PROPELLED ROAD MILLING MACHINE FOR MILLING ROAD SURFACES, IN PARTICULAR LARGE-SCALE MILLING MACHINE, AND METHOD FOR MILLING ROAD SURFACES

BACKGROUND OF THE INVENTION

1. Field of the Invention

The invention relates to a self-propelled road milling machine for milling road surfaces, in particular large-scale milling machines, and a method for milling road surfaces.

2. Description of the Prior Art

Road milling machines having a milling width of approximately 1500 mm and more are referred to as large-scale milling machines, for example. Such road milling machines have a large weight and are thus normally supported by a chassis comprising crawler-type traveling gears. The milling roller is supported at the machine frame between the traveling gears of the front axle and the rear axle in spaced relationship to the axles. Large-scale milling machines comprise a height adjustable chassis including front and rear traveling gears which define the front axle and the rear axle, respectively. The machine frame is supported by the chassis, wherein between the axles of the front and rear traveling gears a milling roller housing is arranged at the machine frame, which comprises a single roller mill rotatably supported in the milling roller housing. The milling roller housing has coupled thereto, via a belt shoe, a conveyor belt means for removing the milling product milled-off and ejected by the milling roller in forward direction, as seen in the direction of travel.

Such a large-scale milling machine is known from EP 2 011 921 A, for example.

A front end of the milling roller housing is nearly flush with an outer side of the machine frame, the so-called zero side, to allow milling to be performed as near as possible to edges or obstacles. The milling roller housing is not adjustable in height relative to the machine frame such that the overall machine weight can be transmitted to the milling roller to produce high cutting forces and thus a large milling depth.

So far large-scale milling machines have been used mainly for milling large surfaces only, inter alia, because of their limited maneuverability, wherein, depending on the course of the road, it has been possible to perform milling work in curves of the road having a large curve radius.

In particular during milling work performed towards the inside relative to the zero side large-scale milling machines are problematic in that it has not been possible for the machine operator to follow a curve with a narrow curve radius. A solution to this problem is described in EP 2 011 921, which allows for a visual check when steering a large-scale milling machine, whereby the maneuverability of a large-scale milling machine could be improved.

In the case of roads with right-hand traffic, the zero side of a road milling machine is preferably provided on the right-hand side of the machine, as seen in the direction of travel. In the case of roads with left-hand traffic, the zero side is preferably provided on the left-hand side (as seen in the direction of travel). It is understood that a large-scale milling machine can be turned around when there is enough room for a turning maneuver and thus a large-scale milling machine having the zero side on the right-hand side, as seen in the direction of travel, can also be used on roads with left-hand traffic. This is disadvantageous in that the road milling machine having its zero side on the right-hand side, as seen in the direction of travel, has to travel opposite to the moving traffic when a road cannot be completely closed when roadwork is performed. Such a situation is encountered, for example, when on a highway the left-hand traffic lane is to be milled flush with the left-hand side of the road. This is disadvantageous in that the trucks receiving the milled-off product in front of the road milling machine must also travel opposite to the traffic flow to the front side of the road milling machine and then travel away from there. Further, when narrow roads are concerned it is often desirable to be able to optionally mill the road on the left-hand or the right-hand side without the need to turn the large-scale milling machine.

For example, in DE 83 15 139 U it is provided that in a road milling machine supported by a wheel-type traveling gear a single hydraulically operated milling roller is displaced transversely to the direction of travel by a small stroke along sliding guides. The machine concerned is not a large-scale milling machine which can produce large cutting forces since the milling roller is supported such that it is pivotable about a horizontal axis and rests on the ground merely due to its dead weight. The milling roller can thus be raised and lowered relative to the machine frame and further can be pivoted about an axis extending in the direction of travel to adapt to the inclination of the road. The capability of being transversely displaced is to allow for an accurate control of the milling track. It is understood that due to this rocker support of the milling roller no large cutting forces can be exerted and such a milling machine is suitable only for milling surfaces where no large milling depths are required.

SUMMARY OF THE INVENTION

It is an object of the present invention to provide a self-propelled road milling machine of the type described above, and a method for milling road surfaces, which machine is more universally usable and whose maneuverability is improved.

According to the present invention, the milling roller drive unit preferably is a hydraulic or electric drive unit integrated in the milling roller, and the milling roller, together with the milling roller housing and the milling roller drive unit, is supported at the machine frame in a displaceable manner transversely to the direction of travel, whereby the zero side is adapted to be defined on the one outer side or on the opposite outer side of the machine frame.

The solution according to the present invention offers the advantage that essentially the overall machine weight acts upon the milling roller due to the arrangement of the milling roller between the axles of the chassis, whereby large milling depths at high advance rates can be achieved. Since the milling roller is capable of being displaced the zero side can optionally be defined on the one outer side or on the opposite outer side such that work can be performed optionally flush right or flush left along obstacles while maintaining the direction of travel. The milling roller can be displaced during milling operation, for which purpose the milling roller preferably comprises additional chiseling tools at its front edges. The milling roller, together with the milling roller housing and the milling roller drive unit integrated in the milling roller, is displaced linearly and transversely to the direction of travel at the machine frame. Linear guiding below the machine frame offers the advantage that neither the milling depth nor the transverse inclination of the milling roller is affected by the linear displacement. This is of importance with regard to leveling of the road milling machine with the aid of a height adjustable chassis. An essential advantage is that only the position of the machine frame must be monitored to make corrections, if necessary. Another advantage is that the milling roller can be displaced during operation without any interruption of operation.

The milling depth can be adjusted via the height adjustable chassis. The high pressure load exerted by the milling roller in connection with the milling roller housing via the machine frame allows for milling depth of at least 30 cm such that during a single passage the complete road surface can be removed.

Turning away from the usual mechanical drive concept comprising a belt drive and integration of preferably two motors into the milling roller allow the position of the milling roller transverse to the direction of travel to be varied.

The milling roller drive is preferable realized on both sides, i.e. using two drive means integrated in the front ends of the milling roller.

Preferably, the milling roller housing is linearly displaced along two linear guides spaced from each other in the direction of travel of the machine frame.

The two linear guides allow for rigidly supporting the milling roller housing at the machine frame and thus rigidly supporting the milling roller in vertical direction such that a precise milling depth adjustment is maintained. Further, the milling roller housing is rigidly supported in the direction of travel such that the milling roller is movable only in transverse direction with respect to the direction of travel.

A first one of the linear guides is a tubular guide and defines a locating bearing, and a second one of the linear guides is a guide arranged between two plane surfaces and defines a non-locating bearing.

The support of the milling roller housing thus comprises a locating bearing and a non-locating bearing, wherein the clearance between the plane surfaces of the non-locating bearing may be adjustable.

Preferably, the linear guides are fixed to the machine frame at a location below the machine frame.

Arrangement of the linear guides below the machine frame offers the advantage that the weight force of the machine can be directly transmitted to the milling roller via the milling roller housing, and that the guides can be arranged in a space saving manner.

The milling roller housing is rigidly fixed to the machine frame in vertical direction and the direction of travel.

The milling roller housing comprises at its front ends respective height adjustable side shields. The cutting circle at the front ends of the milling roller when milling along an obstacle, e.g. a lamppost or a bridge pier, is preferably spaced from the obstacle by less than 120 mm, preferably 105 mm, or less than 105 mm.

The maximum lateral traveling distance of the milling roller ranges between 500 and 1000 mm. This traveling distance allows the zero side to be optionally defined on the left-hand or the right-hand side of the road milling machine.

The milling roller is preferably adapted to be hydraulically driven on both sides. The both-sided drive offers the advantage that the torsional load of the milling roller can be reduced, and that finally a higher power can be transmitted to the milling roller. Alternatively, an electric drive unit can be provided.

At the milling roller housing a belt shoe for receiving the lower end of the conveyor belt means can be fixed in a height adjustable manner. The belt shoe can follow the movement of the milling roller housing transversely to the direction of travel such that the lower end of the conveyor belt means is always arranged at the milling product ejection opening at the milling roller housing.

For this purpose it is provided that the conveyor belt means is articulated to the belt shoe.

For articulating the lower end of the conveyor belt means to the belt shoe, the belt shoe comprises an essentially concave, preferably spherical reception socket which cooperates with a lower side of the lower end of the conveyor belt means, whose shape is adapted to the shape of the reception socket.

The front side of the conveyor belt means at the machine frame is adapted to be displaced in longitudinal direction along the longitudinal axis of the conveyor belt means and is supported by a cardan joint.

The conveyor belt means is adapted to be pivoted at its front side about a vertical axis, which is vertical when the machine frame is horizontally aligned, and a transverse axis extending in parallel to the milling roller axis.

At least on the front side the conveyor belt means comprises on the lower side a conveyor belt-side support element preferably having a convex bearing surface and extending essentially in the longitudinal direction of the conveyor belt means for ensuring flexible support, said support element being laterally guided and resting on a frame-side support element preferably having a convex supporting surface and fixed transversely to the direction of travel at the machine frame. The bearing surface and the support surfaces define a cardan joint, which additionally offers the advantage that even a slight rolling motion about the longitudinal axis of the conveyor belt means is possible.

The conveyor belt-side support element and/or the frame-side support element can be defined by a profile with a rounded cross section or a hollow profile. They may preferably rest on top of each other and thus allow a point support which permits displacement of the conveyor belt means along its longitudinal axis.

The belt shoe is preferably height adjustable via a synchronized guide. Guiding of the belt shoe for raising and lowering purposes is performed in the form of linear guiding where the height adjustment is effected synchronously by the same amount on the right-hand and the left-hand side of the belt shoe.

At the milling roller housing a hydraulic angular manifold for supplying the hydraulic drive units, at least the milling roller drive units provided at the milling roller housing may be fixed in place.

The hydraulic angular manifold fixed in place at the milling roller housing allows the hydraulic lines at the milling roller housing to extend in a rigid manner to the drive units and prevent excessively narrow bend radii of the supply lines from the hydraulic pumps.

For improving the maneuverability and permitting universal usability of a large-scale milling machine, the rear end, as seen in the direction of travel, of the milling roller housing may be flush with a height adjustable stripper shield which, in the milling track of the milling roller, laterally and resiliently bears upon milling edges of the milling track extending orthogonally to the road surface.

Since the stripper shield is adapted to laterally spring-deflect, the large-scale milling machine can travel narrow curve radii without the stripper shield getting jammed. Another advantage is that, since the stripper shield elastically bears upon the milling edge of the milling track, the stripper shield can strip the milling track without leaving milling product residues.

The rear end, as seen in the direction of travel, of the milling roller housing can be flush with a height adjustable stripper shield which comprises at both lateral ends a respective movable shield element whose lower edge is essentially flush with the stripper shield and which, together with the latter, is adjustable in height, wherein the shield elements, together with the stripper shield and the milling roller axle, are adjustable against a spring bias to dynamically adapt the stripper shield width during the milling operation.

In a method for milling road surfaces using a self-propelled road milling machine comprising a machine frame including lateral outer sides, a single rotatably supported milling roller and a milling roller drive unit for the milling roller, wherein a front end of the milling roller is nearly flush with a lateral outer side of the machine frame, the so-called zero side, to allow milling to be performed as near as possible to edges or obstacles, it is provided that the zero side is optionally defined on the one outer side or on the opposite outer side of the machine frame by integrating the milling roller drive unit as a hydraulic or electric drive unit in the milling roller and supporting the milling roller, together with the milling roller drive unit, in a displaceable manner transversely to the direction of travel.

BRIEF DESCRIPTION OF THE DRAWINGS

Hereunder an exemplary embodiment of the present invention is described in detail with reference to the drawings in which.

DETAILED DESCRIPTION

Figure 1:
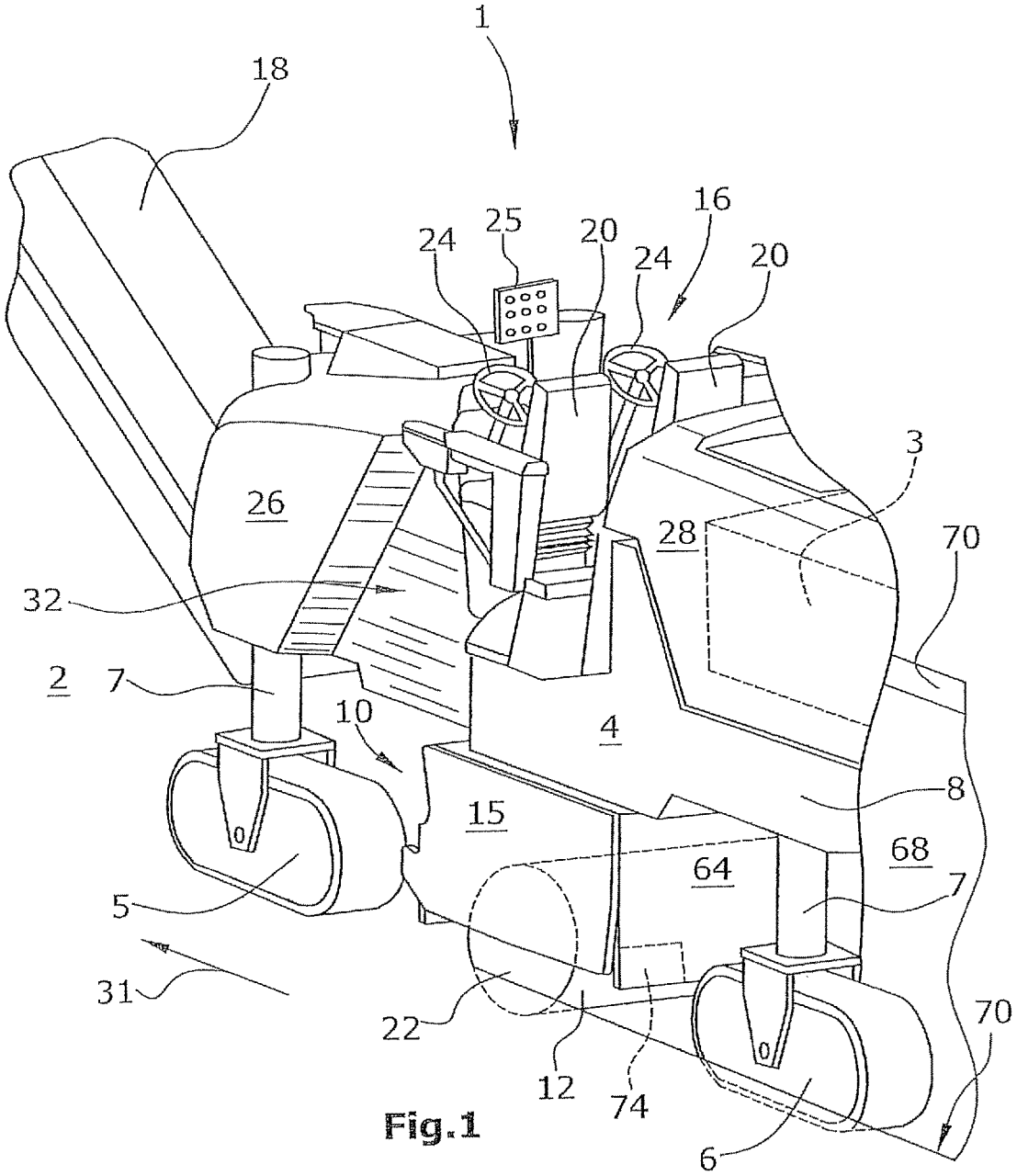
FIG. 1 shows a schematic partial view of the self-propelled road milling machine.

FIG. 1 shows a road milling machine 1, in particular a large-scale milling machine, comprising a machine frame 8 and a chassis 4 including front and rear traveling gears 5,6, as seen in the direction of travel 31. The traveling gears 5,6 define a steerable front axle and a steerable rear axle. The chassis 4 is connected with the machine frame 8 via lifting columns 7 with the aid of which the distance of the machine frame 8 to a road surface 2 is adjustable. Each chassis axle comprises at least one crawler-type traveling gear 5,6 or a wheel-type traveling gear.

At a front side, as seen in the direction of travel, of the road milling machine 1 a vertically and laterally pivotable conveyor belt means 18 for removing the milled-off milling product is arranged.

The front and rear traveling gears 5,6 of the chassis 4 may be crawler-type traveling gears or wheel-type traveling gears.

The machine frame 8 comprises lateral outer sides 26,28 essentially extending vertically and in parallel to the longitudinal center axis of the road milling machine 1. It is understood that the outer sides 26,28 need not extend perfectly vertically and absolutely in parallel to the longitudinal center axis of the road milling machine 1 and that minor deviations are acceptable. The outer side 26,28 is preferably integral, wherein the outer sides 26 and 28 preferably lie in the same plane.

Between the traveling gears 5,6 a milling roller 12 is arranged which, together with its milling roller axle, is supported in a milling roller housing 10.

The one front end 22 of the milling roller 12 comes up to the outer side 26,28 of the machine frame 8 shown as the zero side in FIG. 1. At the zero side the corresponding front end 22 of the milling roller 12 is located very near to the outer side of the road milling machine 1 such that milling can be performed very near to road edges or obstacles.

In the front end 22 of the milling roller 12 hydraulic or electric milling roller drive units 14 are preferably integrated on both sides, which are supplied by hydraulic pumps or generators arranged at the machine frame 8, which in turn are driven by a combustion engine 3 supplying the driving power for the traction drive unit, the milling drive unit and auxiliary equipment.

At the front ends 22 of the milling roller 12 and next to the milling roller housing 10 a respective height adjustable side shield 15 is arranged which serves as an edge guard.

The milling roller 12 is preferably arranged centrally between the front traveling gear 5 and the rear traveling gear 6, as seen in the direction of travel 31.

The milling roller 12 is provided with tools 13. The milling roller 12 rotates in clockwise direction as seen from the right-hand side of FIG. 2.

The single milling roller 12 may be composed of a plurality of parts or of at least one tubular roller slid upon a base body, for example. Likewise, the milling roller may be composed of a plurality of segments.

Above the milling roller 12 there is a driver's platform 16 which may comprise two seats 20 and two steering means 24 which are respectively provided for flush left and flush right milling along a road. It is understood that a driver's platform adapted to be displaced transversely to the direction of travel and comprising one seat 20 with an associated steering means 24, which is displaceable to the left-hand side or the right-hand side of the road milling machine 1, as required, may also be used.

The seat 20 is preferably aligned with respect to the lateral outer wall 26,28 such that the seat 20 at least partly laterally projects beyond the outer wall 26,28.

If the zero side of the road milling machine 1 is moved along an obstacle, e.g. a lamppost, the driver's platform 16 including the seat 20, an arm rest and an operator's panel 25 can be displaced inwardly to allow for flush milling along the obstacle.

The outer side 26,28 comprises a recess 32 in front of the driver's platform 16. This recess 32 allows the front traveling gear 5 and thus the current steering angle to be monitored.

In FIG. 1 the milling roller housing 10 is shown with a raised stripper shield 64, wherein the side shield 15 is also raised to show the position of the milling roller 12. The milling roller housing 10 is supported at the machine frame 8 such that it is adapted to be displaced linearly and transversely to the direction of travel 31, whereby the zero side can be optionally defined on the one outer side 26,28 or on the opposite outer side 26,28 of the machine frame 8.

Displacement of the milling roller housing 10 is performed with the aid of two guides 34,36 spaced from each other in the direction of travel of the machine frame 8 and configured as linear guides.

Figure 2:
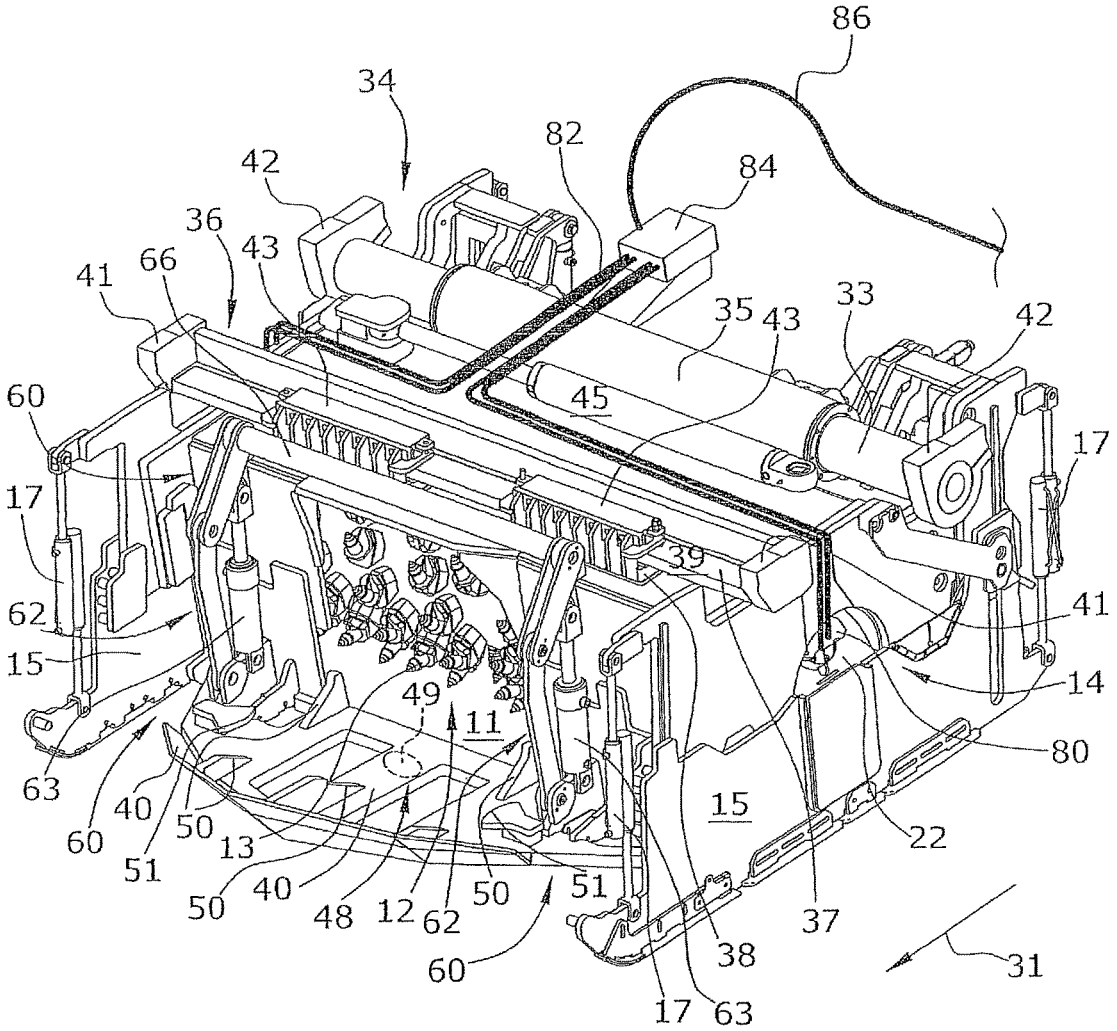
FIG. 2 shows a milling roller housing as a displaceable module.
Figure 3:
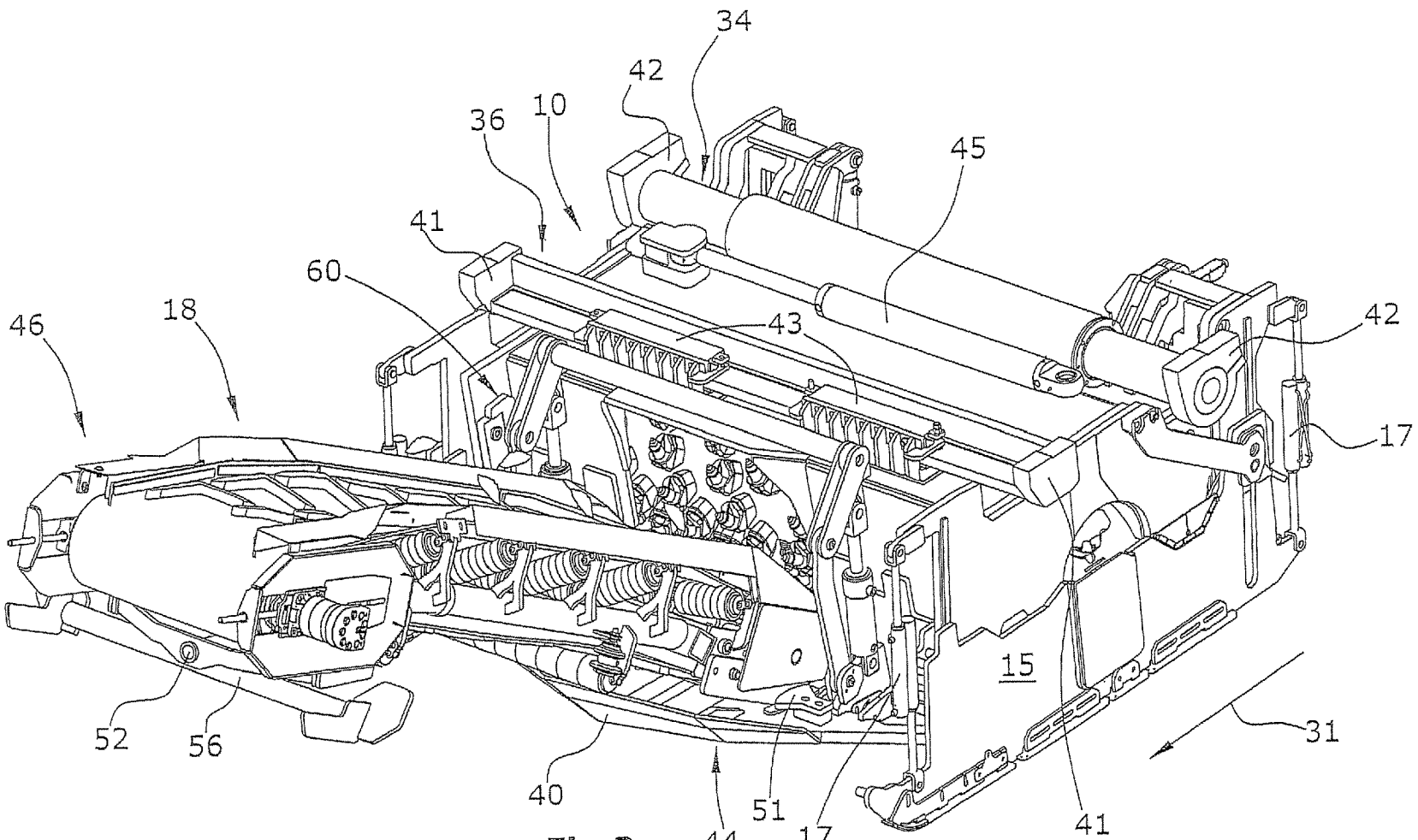
FIG. 3 shows the milling roller housing with an articulated conveyor belt means.
Figure 4:
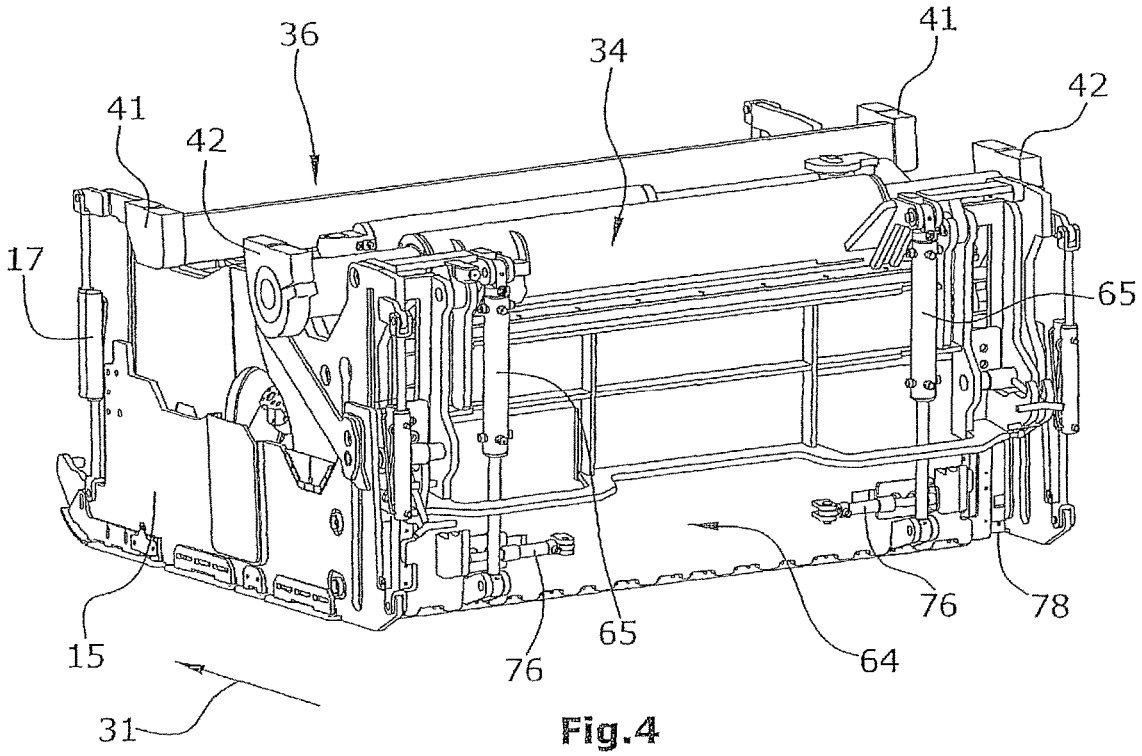
FIG. 4 shows a rear view of the milling roller housing comprising a stripper shield.

The first one of the linear guides 34 is a tubular guide which, in FIGS. 2 to 4, is arranged on the upper side of the milling roller housing 10.

The second linear guide 36 is also arranged in spaced relationship on the upper side of the milling roller housing 10. Linear guiding is performed between the plane surfaces 37,38 as can best be seen in FIGS. 2 and 3. The plane surface 37 is provided on both the upper side and the lower side of a beam 39 which is fixed in place on the lower side of the machine frame 8 using flange parts 41. The plane surfaces 37 are encompassed by guide parts 43 fixed in place at the milling roller housing 10 and comprising the plane surfaces 38 which are in contact with the plane surfaces 37 of the beam 39. The distance of the plane surfaces 38, which are in contact with the plane surfaces 37, is adjustable such that the clearance between the plane surfaces 37 and 38 can be adjusted with the aid of the guide parts 43.

The second linear guide 36 defines a non-locating bearing, while the tubular guide of the first linear guide 34 defines the locating bearing.

The tubular guide is composed of an inner tube 33 fixed in place at the lower side of the machine frame 8 via flange parts 42, on which a hollow cylinder 35 fixed in place at the milling roller housing 10 can slide.

A piston cylinder unit 45 whose one end is fixed to the machine frame 8 and whose other end is fixed to the milling roller housing 10 is adapted to displace the overall unit of the milling roller housing 10 including the milling roller 12 and the other elements of the milling roller housing 10 shown in FIGS. 2 and 3, inclusive of the lower end 44 of the conveyor belt unit 18, between a position of the milling roller 12 flush left or flush right with respect to the outer side of the road milling machine 1.

The stroke of the piston cylinder unit 45 preferably ranges between approximately 500 and approximately 1000 mm. This means that the milling roller housing 10 including all the components shown in FIGS. 2 and 3 can be displaced by this traveling distance transversely to the direction of travel 31. For example, if the front end of the milling roller 12 is at a location on the left-hand side of the machine, as seen in the direction of travel 31, and on the other side of or near the outer side 26,28, then the zero side of the machine is provided on the left-hand side.

The stroke of the piston cylinder unit 45 is regarded in relation to the width of the milling roller 12 which is approximately 1500 mm and more, typically 2000 mm, in large-scale milling machines. The piston cylinder unit 45 can exert sufficiently large forces to displace the milling roller housing 10 including the milling roller 12 even during milling operation. For this purpose, additional tools 13 may be provided at the respective front ends of the milling roller.

The two linear guides 34,36 arranged in spaced relationship to each other, as seen in the direction of travel of the machine frame 8, are preferably spaced from each other as far as possible. They can transmit the machine weight to the milling roller housing 10 and to the milling roller 12 supported therein to produce large cutting forces at large milling depths.

The combination of the linear guides 34,36 allows for an optimum absorption of the produced forces and torques.

The side shield 15 is fixed on both sides of the milling roller housing 10 via double arrangement of piston cylinder units 17, wherein the double arrangement allows for a particularly large stroke of the piston cylinder units 17.

As can only be seen in FIG. 2, the illustrated exemplary embodiment of a milling roller drive unit 14 may comprise at least one hydraulic drive unit 80 which is integrated in the front end 22 of the milling roller 12. The illustrated exemplary embodiment shows a hydraulic drive unit 80 at both front ends 22 of the milling roller 12, wherein hydraulic supply lines 82 extending to the drive units 80 are connected via a manifold 84 and further hydraulic lines 86 with a hydraulic pump driven by the combustion engine 3.

The further hydraulic lines 86 are schematically shown as a single line. It is understood that the at least one hydraulic drive unit 80 requires at least one supply and return line. The manifold 84 is fixed in place at the milling roller housing 10 such that the hydraulic lines 82 need not be flexible and merely the further hydraulic lines 86 must be deformable in such a manner that the traveling distance of the displaceable unit can be configured as shown in FIG. 2.

In FIGS. 2 and 3 a belt shoe 40 is arranged at the front end of the milling roller housing 10, which serves for receiving the lower end 44 of the conveyor belt means 18.

The belt shoe 40 receives the lower end 44 of the conveyor belt means 18. The belt shoe 40 is arranged centrally with respect to an ejection opening 11 of the milling roller housing 10 and can be adjusted in height with the aid of a synchronous guide 60. The synchronous guide 60 is composed of two link mechanisms 62 each including a piston cylinder unit 63 and arranged next to the conveyor belt means 18, wherein the synchronism of the two link mechanisms 62 is ensured via a coupling shaft 66 such that the synchronous guide cannot get jammed.

FIG. 3 shows a representation corresponding to that of FIG. 2 with an integrated conveyor belt means 18.

Figure 5:
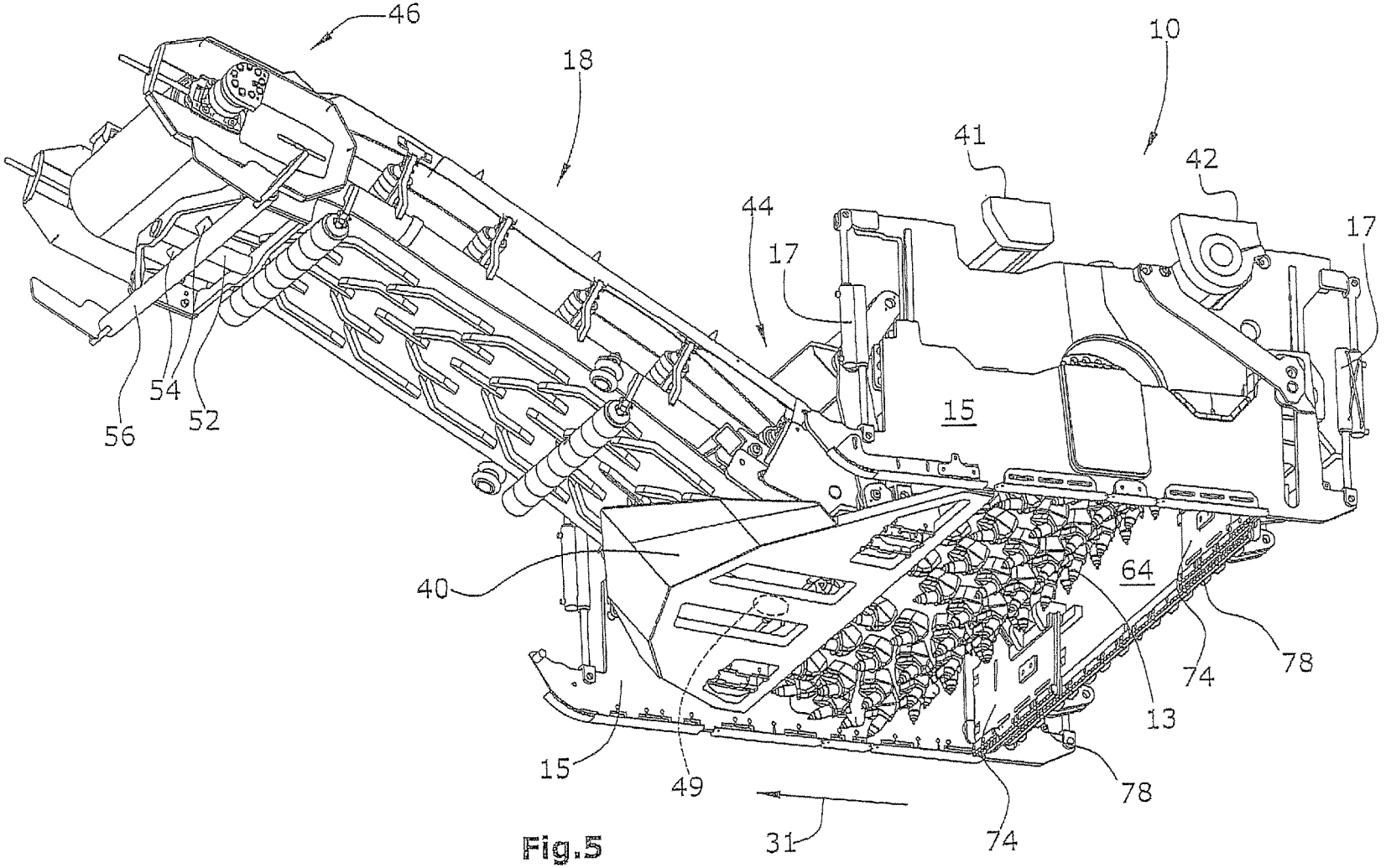
FIG. 5 shows a perspective bottom view of a combination of the milling roller housing with the conveyor belt means coupled thereto.

The front support of the conveyor belt means 18 can best be seen in FIG. 5. At the machine frame 8 a frame-side support element 56 is fixed in place. The frame-side support element 56 preferably comprises a convexly rounded support surface, a tube in the present exemplary embodiment, upon which the front upper end 46 of the conveyor belt means 18 can rest via a conveyor belt-side support element 52. Since both support elements 52,56 comprise convexly rounded support surfaces, the front side 46 of the conveyor belt means 18 is supported in a point support, wherein the support defines a cardan joint. Further, the conveyor belt-side support element 52 can be displaced in longitudinal direction when the milling roller housing 10 is displaced from one side to the other side of the road milling machine 1. The articulated support further allows for slight rolling motion of the conveyor belt means 18.

Lateral guides 54 secure the conveyor belt-side support element 52 in position.

Due to the displacement motion of the milling roller housing 10 transversely to the direction of travel 31 it is required that the lower end 44 of the conveyor belt means 18 is received on the belt shoe 40 in an articulated manner.

The belt shoe 40 may comprise an essentially concave, preferably spherical receiving socket 48 for receiving the lower end 44 in an articulated manner, said receiving socket 48 cooperating with a lower side of the lower end 44 of the conveyor belt means 18 whose shape is adapted to the shape of the receiving socket 48. This articulated reception of the lower end 44 of the conveyor belt means 18 allows for raising the belt shoe 40 together with the lower end 44 of the conveyor belt means 18 and for displacing the milling roller housing 10 by a traveling distance of 500 to 1000 mm, wherein the lower end 44 of the conveyor belt means 18 is always arranged in front of the ejection opening 11 of the milling roller housing 10.

The receiving socket 48 is defined by inclined surfaces 50 which receive the lower end 44 of the conveyor belt means 18. Additionally, lateral guides elements 51 are provided which allow, on the one hand, the lower end 44 to be pivoted about a vertical axis and, on the other hand, the lower end 44 to be laterally secured in position. The lower end 44 of the conveyor belt means 18 comprises centrally on its lower side a preferably spherical support means 49 which is shown dashed in FIG. 2 and which rests on the belt shoe 40 in an area in front of the central inclination 50. The support element 49 and its resting position are also shown dashed in FIG. 5.

The ejection opening 11 of the milling roller housing 10 need not be arranged centrally with respect to the milling roller housing 10 but can also be eccentrically arranged. The tools 13 of the milling roller 12 are spirally arranged in circumferential direction, wherein the milling roller 12 comprises opposed spirals of tools 13 which transport the milled-off material to the ejection opening 11 and convey it from the ejection opening 11 to the conveyor belt means 18.

FIG. 4 shows a perspective rear view of the milling roller housing 10 at which a height adjustable stripper shield 64 is arranged with the aid of piston cylinder units 65. The stripper shield 64 is further adapted to be pivoted upwards when the tools 13 at the milling roller 12 must be accessible.

At its side facing the milling roller 12 the stripper shield 64 comprises at its lateral outer edges a respective shield element 74 which is adapted to be pressed, with the aid of a resilient biasing means 76 (FIG. 4), against the milling edge 70 (FIG. 1) extending orthogonally to the road surface 2.

The lower edge 78 of the laterally movable shield element 74 is flush with the lower edge of the stripper shield 64. The shield elements 74 are adjustable in height together with the stripper shield 64. The resilient biasing means 76 can produce the bias in various ways. In the exemplary embodiment shown in FIG. 4 the biasing means 76 are shown as piston cylinder elements which are adapted to be hydraulically biased.

What is claimed is:

1. A self-propelled road milling machine for milling road surfaces, comprising:

front and rear ground engaging supports, as seen in a direction of travel;

a machine frame;

front and rear height adjustable lifting columns supporting the machine frame from the front and rear ground engaging supports, respectively;

a milling roller housing arranged at said machine frame between said front and rear ground engaging supports;

a single milling roller rotatably supported in said milling roller housing;

a hydraulic or electric milling roller drive unit integrated in said milling roller;

a conveyor belt cooperating with said milling roller housing to remove milling product milled off by said milling roller in a forward direction as seen in the direction of travel; and two linear guides fixed to said machine frame and located below said machine frame between said front and rear ground engaging supports, the two linear guides being spaced from each other in said direction of travel, said milling roller housing and said milling roller being supported on said two linear guides between said front and rear ground engaging supports such that a weight force of said milling machine can be transmitted to said milling roller via said milling roller housing by height adjustment of each of said front and said rear lifting columns; and wherein said milling roller, together with said milling roller housing and said milling roller drive unit, is supported so as to be displaceable along the two linear guides transversely to the direction of travel between multiple operating positions of said milling roller.

2. A self-propelled road milling machine for milling road surfaces, comprising:

front and rear ground engaging supports, as seen in a direction of travel;

a machine frame;

front and rear height adjustable lifting columns supporting the machine frame from the front and rear ground engaging supports, respectively;

a milling roller housing arranged at said machine frame between said front and rear ground engaging supports;

a single milling roller rotatably supported in said milling roller housing;

a hydraulic or electric milling roller drive unit integrated in said milling roller;

a conveyor belt cooperating with said milling roller housing to remove milling product milled off by said milling roller in a forward direction as seen in the direction of travel; and two linear guides fixed to said machine frame and located below said machine frame between said front and rear ground engaging supports, the two linear guides being spaced from each other in said direction of travel, said milling roller housing and said milling roller being supported on said two linear guides between said front and rear ground engaging supports such that a weight force of said milling machine can be transmitted to said milling roller via said milling roller housing by height adjustment of each of said front and said rear lifting columns; and wherein said milling roller, together with said milling roller housing and said milling roller drive unit, is supported so as to be displaceable along the two linear guides transversely to the direction of travel; and wherein a first one of the linear guides is a tubular guide defining a locating bearing, and a second one of the linear guides is a guide arranged between plane surfaces and defining a non-locating bearing.

3. The self-propelled road milling machine according to claim 1, wherein a maximum lateral traveling distance of the milling roller is in a range from 500 to 1000 mm.

4. The self-propelled road milling machine according to claim 1, further comprising a belt shoe configured to receive a lower end of the conveyor belt and fixed in a height adjustable manner relative to the milling roller housing.

5. The self-propelled road milling machine according to claim 4, wherein the conveyor belt is articulated to the belt shoe.

6. The self-propelled road milling machine according to claim 4, wherein the belt shoe comprises a concave receiving socket configured to articulatedly receive the lower end of the conveyor belt, said receiving socket cooperating with a lower side of said lower end of said conveyor belt, the lower end of the conveyor belt being shaped complementary to a shape of said receiving socket.

7. The self-propelled road milling machine of claim 6, wherein the shape of the receiving socket is partially spherical.

8. The self-propelled road milling machine according to claim 4, wherein the belt shoe is adjustable in height via a synchronous guide.

9. The self-propelled road milling machine according to claim 1, wherein a front upper end of the conveyor belt is supported by a cardan joint at the machine frame such that the front upper end of the conveyor belt is longitudinally displaceable along a longitudinal axis of said conveyor belt.

10. A self-propelled road milling machine for milling road surfaces, comprising:

front and rear ground engaging supports, as seen in a direction of travel;

a machine frame;

front and rear height adjustable lifting columns supporting the machine frame from the front and rear ground engaging supports, respectively;

a milling roller housing arranged at said machine frame between said front and rear ground engaging supports;

a single milling roller rotatably supported in said milling roller housing;

a hydraulic or electric milling roller drive unit integrated in said milling roller;

a conveyor belt cooperating with said milling roller housing to remove milling product milled off by said milling roller in a forward direction as seen in the direction of travel;

two linear guides fixed to said machine frame and located below said machine frame between said front and rear ground engaging supports, the two linear guides being spaced from each other in said direction of travel, said milling roller housing and said milling roller being supported on said two linear guides between said front and rear ground engaging supports such that a weight force of said milling machine can be transmitted to said milling roller via said milling roller housing by height adjustment of each of said front and said rear lifting columns;

wherein said milling roller, together with said milling roller housing and said milling roller drive unit, is supported so as to be displaceable along the two linear guides transversely to the direction of travel;

a conveyor-side support element located below a lower side of the conveyor belt and extending in the direction of the conveyor belt and having a convex bearing surface; and a frame-side support element having a convex supporting surface and being fixed transversely to the direction of travel to the machine frame, said conveyor-side support element being laterally guided and resting on said frame-side support element.

11. The self-propelled road milling machine according to claim 10, wherein at least one of the conveyor-side support element and the frame-side support element are defined by a profile with a rounded cross section.

12. The self-propelled road milling machine according to claim 10, wherein at least one of the conveyor-side support element and the frame-side support element are defined by a hollow profile.

13. A self-propelled road milling machine for milling road surfaces, comprising:

front and rear ground engaging supports, as seen in a direction of travel;

a machine frame;

front and rear height adjustable lifting columns supporting the machine frame from the front and rear ground engaging supports, respectively;

a milling roller housing arranged at said machine frame between said front and rear ground engaging supports;

a single milling roller rotatably supported in said milling roller housing;

a hydraulic or electric milling roller drive unit integrated in said milling roller;

a conveyor belt cooperating with said milling roller housing to remove milling product milled off by said milling roller in a forward direction as seen in the direction of travel; and two linear guides fixed to said machine frame and located below said machine frame between said front and rear ground engaging supports, the two linear guides being spaced from each other in said direction of travel, said milling roller housing and said milling roller being supported on said two linear guides between said front and rear ground engaging supports such that a weight force of said milling machine can be transmitted to said milling roller via said milling roller housing by height adjustment of each of said front and said rear lifting columns; and wherein said milling roller, together with said milling roller housing and said milling roller drive unit, is supported so as to be displaceable along the two linear guides transversely to the direction of travel; and wherein the milling roller housing includes a height adjustable stripper shield at a rear of the milling roller housing, the stripper shield configured to rest laterally across a milling track of the milling roller, and the stripper shield configured to rest resiliently against milling edges of the milling track extending orthogonally to the road surface.

* * * * *